US009228293B2

(12) United States Patent
Yeom

(10) Patent No.: US 9,228,293 B2
(45) Date of Patent: Jan. 5, 2016

(54) CLOTHING DRYER

(75) Inventor: Chang Bae Yeom, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 970 days.

(21) Appl. No.: 13/302,218

(22) Filed: Nov. 22, 2011

(65) Prior Publication Data

US 2012/0144687 A1 Jun. 14, 2012

(30) Foreign Application Priority Data

Dec. 14, 2010 (KR) ..... 10-2010-0127936

(51) Int. Cl.

| | |
|---|---|
| ***F26B 11/02*** | (2006.01) |
| ***F26B 21/06*** | (2006.01) |
| ***D06F 58/22*** | (2006.01) |
| ***D06F 58/04*** | (2006.01) |

(52) U.S. Cl.

CPC ..... *D06F 58/22* (2013.01); *D06F 58/04* (2013.01)

(58) Field of Classification Search

CPC ..... D06F 58/22; D03J 1/002
USPC ..... 34/82, 480, 603; 16/415, 416, 430, 412, 16/111.1; 312/330.1
See application file for complete search history.

(56) References Cited

U.S. PATENT DOCUMENTS

| | | | | |
|---|---|---|---|---|
| 3,320,678 | A * | 5/1967 | Berke | 34/82 |
| 4,103,433 | A | 8/1978 | Taylor | |
| 7,020,986 | B1 * | 4/2006 | Nakai et al. | 34/596 |
| 7,497,030 | B2 * | 3/2009 | Belgard | 34/82 |
| 7,798,486 | B2 * | 9/2010 | Hasegawa et al. | 271/145 |
| 2010/0154240 | A1 * | 6/2010 | Grunert | 34/82 |
| 2011/0225838 | A1 * | 9/2011 | Ahn et al. | 34/82 |

FOREIGN PATENT DOCUMENTS

| | | |
|---|---|---|
| KR | 10-2003-0032170 | 4/2003 |
| KR | 10-2004-0056813 | 7/2004 |
| KR | 10-2006-0085792 | 7/2006 |

* cited by examiner

*Primary Examiner* — Kenneth Rinehart
*Assistant Examiner* — John McCormack
(74) *Attorney, Agent, or Firm* — Staas & Halsey LLP

(57) ABSTRACT

The clothing dryer includes a filter device to filter foreign matter in a flow channel along which high-temperature, high-humidity air having dried an object to be dried is discharged. The filter device is mounted so as to be moved inward into and outward from a cabinet in a horizontal state. Usability and reliability of the clothing dryer are improved.

20 Claims, 7 Drawing Sheets

CLOTHING DRYER

CROSS-REFERENCE TO RELATED APPLICATIONS

This application claims the benefit of Korean Patent Application No. 2010-0127936, filed on Dec. 14, 2010 in the Korean Intellectual Property Office, the disclosure of which is incorporated herein by reference.

BACKGROUND

1. Field

Embodiments relate to a clothing dryer including a filter device to filter foreign matter from air during drying of clothing.

2. Description of the Related Art

Generally, a clothing dryer is an apparatus that supplies hot air generated by an electric heater or a gas burner to an object, for example, such as clothing, placed in a drum to dry the clothing.

The clothing dryer is configured so that moisture contained in the object is absorbed by high-temperature, low-humidity air supplied into the drum, and high-temperature, high-humidity air, which has absorbed the moisture, is circulated or discharged along a duct.

Meanwhile, the circulated or discharged air contains foreign matter, for example, such as lint. The clothing dryer includes a filter device to filter such foreign matter, thereby preventing the foreign matter from being introduced into a fan or other components mounted in the clothing dryer.

SUMMARY

It is an aspect to provide a clothing dryer with improved usability and reliability.

Additional aspects of the invention will be set forth in part in the description which follows and, in part, will be apparent from the description, or may be learned by practice of the invention.

In accordance with one aspect of the present invention, a clothing dryer includes a cabinet having a front frame at which an introduction port is formed, a door rotatably mounted at the front frame to open and close the introduction port, a drying drum rotatably mounted in the cabinet, a filter duct disposed adjacent to the rear of the front frame to form a portion of a flow channel along which air having dried clothing in the drying drum is discharged, and a filter device detachably mounted in the filter duct so as to be moved inward into and outward from the cabinet in a horizontal state to filter foreign matter from air introduced into the filter duct.

The filter device may include a filter case forming a portion of the front frame and a filter mounted in the flow channel of the filter duct, and the filter may be detachably mounted at the filter case.

The filter duct may have a filter insertion port through which the filter is inserted into the flow channel of the filter duct.

The filter duct may include an inlet communicating with the drying drum and an outlet communicating with a blowing case having a fan mounted therein to generate suction force in the drying drum, and the inlet may be provided with a net type filter grill.

The front frame may be provided with a filter mounting part in which the filter case is mounted and supported, and the filter case may include a front cover to cover the filter mounting part and a filter location frame in which the filter is located, the filter location frame being mounted in the filter duct.

The front cover may be disposed adjacent to the lower side of the door, and the front cover is provided with a depression part corresponding to a lower end portion of the door.

The depression part may be provided with a depressed grip part configured to be held by a user.

The filter may include a quadrangular filter frame located and supported in the filter location frame and a filter net mounted inside the filter frame to filter out foreign matter, the filter net being formed in the shape of a box opened at the top thereof.

The filter net may be made of woolen fabric, polyethylene terephthalate (PET), or steel.

The filter duct may be disposed adjacent to the lower side of the introduction port.

The clothing dryer may further include a front support plate to rotatably support the front end of the drying drum, the front support plate having an opening corresponding to the introduction port, and the filter duct may be disposed between the front frame and the front support plate.

The front cover may be provided with a door contact part configured to come into tight contact with one side of the rear of the door when the filter device is mounted at the cabinet.

In accordance with another aspect of the present invention, a clothing dryer includes a cabinet having a front frame at which an introduction port is formed, a drying drum rotatably mounted in the cabinet, a filter device to filter foreign matter in a flow channel along which air having dried an object to be dried in the drying drum is discharged by suction force of a fan, and a filter mounting part formed at one side of the front frame so that the filter device is mounted in the filter mounting part.

The filter device may include a box type filter mounted in the flow channel to filter out the foreign matter, and the filter device may be mounted so as to be moved inward into and outward from the filter mounting part in a horizontal state.

The filter device may include a front cover to cover the filter mounting part and a filter location frame extending from a rear of the front cover so that the filter is located in the filter location frame.

The clothing dryer may further include a door rotatably to open and close the introduction port, the filter mounting part may be disposed adjacent to a lower side portion of the introduction port, and the front cover may include a depression part corresponding to a lower side portion of the door and a door contact part configured to come into contact with one side of the rear of the door.

The filter may be detachably mounted in the filter location frame, and the filter may be made of woolen fabric, PET, or steel.

The clothing dryer may further include a fan mounted in the flow channel to generate suction force to suction air in the drying drum and a filter duct mounted in the flow channel upstream of the fan. The filter duct may be provided with a filter insertion port formed in a shape corresponding to the filter so that the filter is inserted into the filter duct through the filter insertion port.

The filter duct may include an inlet communicating with the drying drum and an outlet communicating with the flow channel in which the fan is mounted, the inlet being provided with a net type filter grill.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
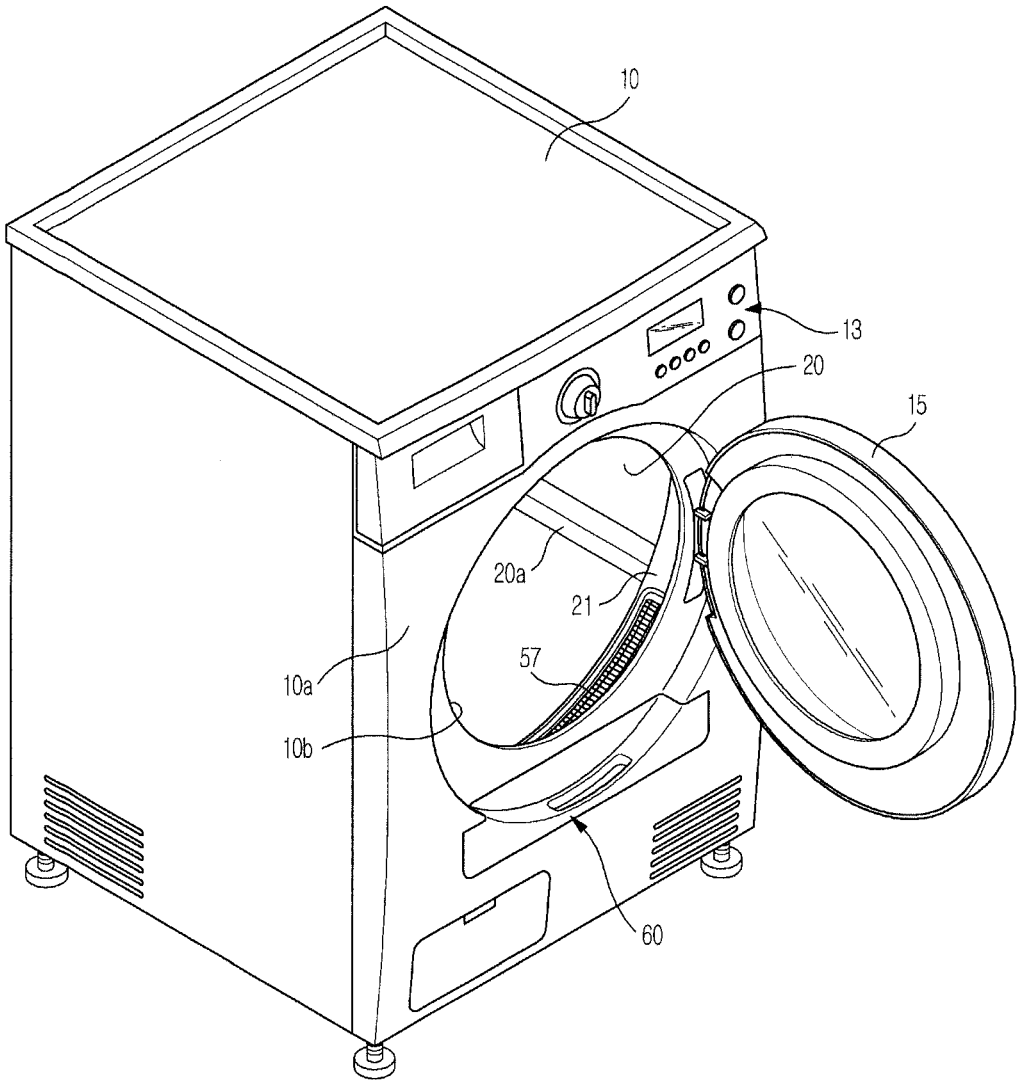
FIG. 1 is a perspective view illustrating the external appearance of a clothing dryer according to an embodiment of the present invention.

Reference will now be made in detail to the embodiments of the present invention, examples of which are illustrated in the accompanying drawings, wherein like reference numerals refer to like elements throughout.

Figure 2:
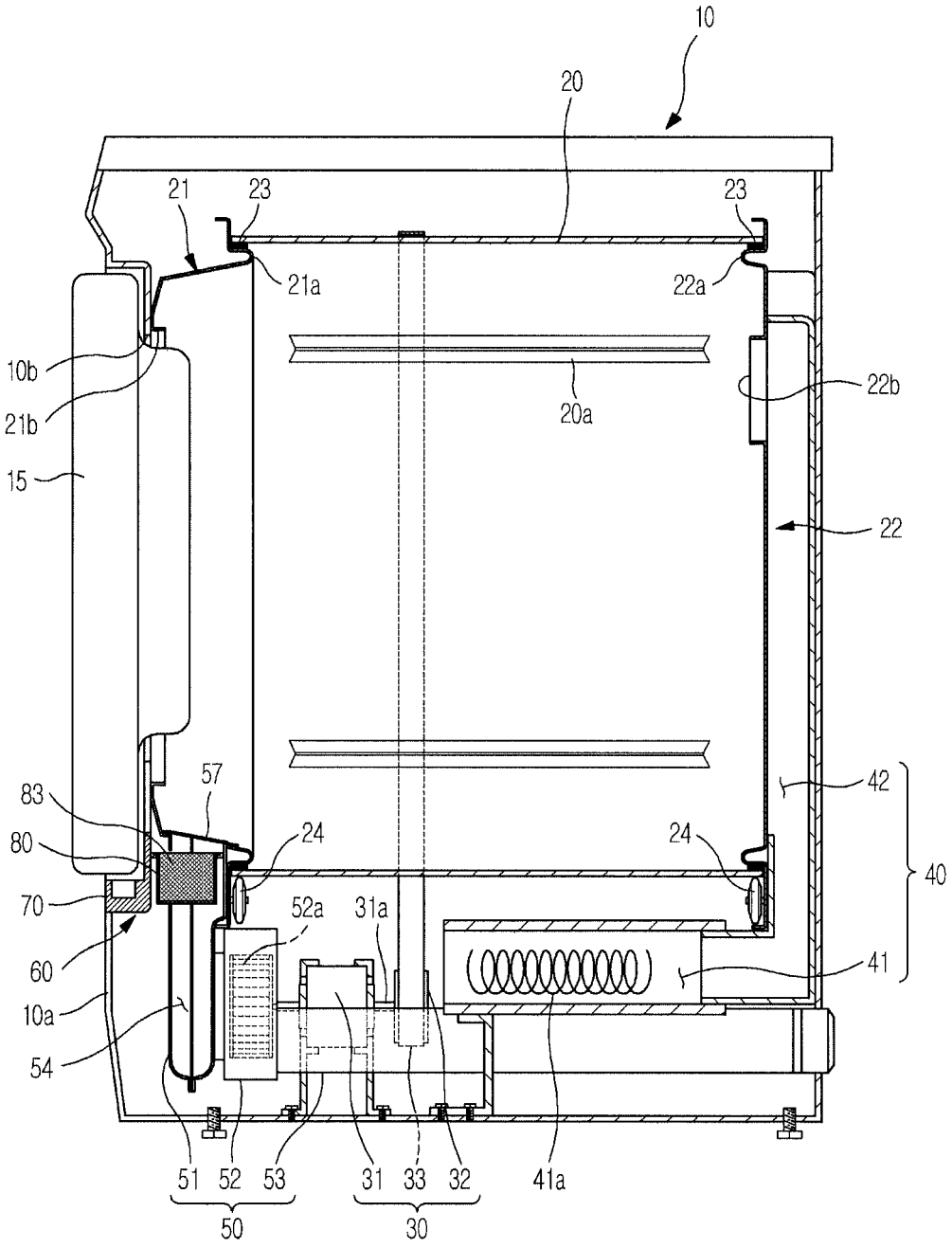
FIG. 2 is a schematic sectional view of the clothing dryer according to the embodiment of the present invention.

FIG. 1 is a perspective view illustrating the external appearance of a clothing dryer according to an embodiment of the present invention, and FIG. 2 is a schematic sectional view of the clothing dryer according to the embodiment of the present invention.

Referring to FIGS. 1 and 2, the clothing dryer includes a cabinet 10 forming the external appearance thereof, a drying drum 20 rotatably mounted in the cabinet 10, a drive unit 30 to rotate the drying drum 20, a hot air supply unit 40 to supply hot air into the drying drum 20, and a hot air discharge unit 50 to discharge the air having dried an object to be dried in the drying drum 20.

The cabinet 10 is provided at the front thereof with a control panel 13 on which various buttons to control the clothing dryer and a display are mounted. Various components to dry clothing are supported in the cabinet 10.

The drying drum 20 is formed in the shape of a cylinder open at the front and rear thereof. A plurality of lifters 20*a* to lift an object to be dried is disposed at the inner circumference of the drying drum 20.

The open front and rear of the drying drum 20 may be covered by a front support plate 21 and a rear support plate 22 fixedly mounted at the front and rear of the cabinet 10, respectively.

The front support plate 21 and the rear support plate 22 may rotatably support the front and rear ends of the drying drum 20, respectively.

To this end, the front support plate 21 and the rear support plate 22 are provided at the edges thereof with a bent front support part 21*a* and a bent rear support part 22*a*, respectively. Friction reducers 23 to reduce frictional resistance are disposed between the drying drum 20 and the support part 21*a* and between the drying drum 20 and the support part 22*a*. Rollers 24 to rotatably support the drying drum 20 may be mounted at the lower parts of the front support plate 21 and the rear support plate 22, respectively.

Introduction ports 10*b* and 21*b*, through which an object to be dried is introduced into the drying drum 20 or taken out of the drying drum 20, are formed at a front frame 10*a* forming the front of the cabinet 10 and the front support plate 21, respectively. A door 15 to open and close the introduction ports 10*b* and 21*b* may be mounted at the front frame 10*a*.

The drive unit 30 may include a drive motor 31 mounted in the cabinet 10 at the lower part thereof and a pulley 32 and a belt 33 to transmit power from the drive motor 31 to the drying drum 20.

The belt 33 is mounted to be wound on the outside of the pulley 32, coupled to one end of a rotary shaft 31*a* of the drive motor 31, and on the outside of the drying drum 20 so that the drying drum 20 is rotated according to the rotation of the drive motor 31.

The hot air supply unit 40 may include a heater 41*a* to heat suctioned air and intake ducts 41 and 42 forming flow channels along which the air heated by the heater 41*a* flows into the drying drum 20.

The intake ducts 41 and 42 may include a lower intake duct 41 mounted below the drying drum 20 and a rear intake duct 42 mounted at the rear of the rear support plate 22 to interconnect an intake port 22*b* and the lower intake duct 41.

High-temperature, low-humidity air supplied into the drying drum 20 by the hot air supply unit 40 dries an object to be dried in the drying drum 20 and then changes into high-temperature, high-humidity air, which is discharged by the hot air discharge unit 50. The hot air discharge unit 50 may include a blowing case 52 having a fan 52*a* to suction the high-temperature, high-humidity air from the drying drum 20 and an exhaust duct 53 forming a flow channel along which the air suctioned by the fan 52*a* is discharged to the outside.

Also, the hot air discharge unit 50 may further include a filter duct 51 mounted below the front support plate 21 so that one end of the filter duct 51 communicates with the drying drum 20 and the other end of the filter duct 51 communicates with the blowing case 52.

A filter device 60 to filter various foreign matter from air introduced into the filter duct 51 may be mounted in the filter duct 51.

In this embodiment, whether the filter device 60 is mounted in the filter duct 51 is confirmed with the naked eye from the front of the front frame 10*a*, thereby preventing damage which may be caused due to the absence of the filter device 60.

To this end, the filter device 60 may include a filter case 70 forming a portion of the front frame 10*a* and a filter 80 mounted in a flow channel of the filter duct 51.

The filter device 60 may be formed in a drawer type structure in which the filter device 60 is pushed into the cabinet 10 and pulled out of the cabinet 10 in the frontward-and-rearward direction of the front frame 10*a* in a horizontal state.

If the filter is pulled upward out of the cabinet to clean the filter, foreign matter may be separated from the filter, with the result that the cabinet may be contaminated. In the above structure, the cabinet is prevented from being contaminated.

Figure 3:
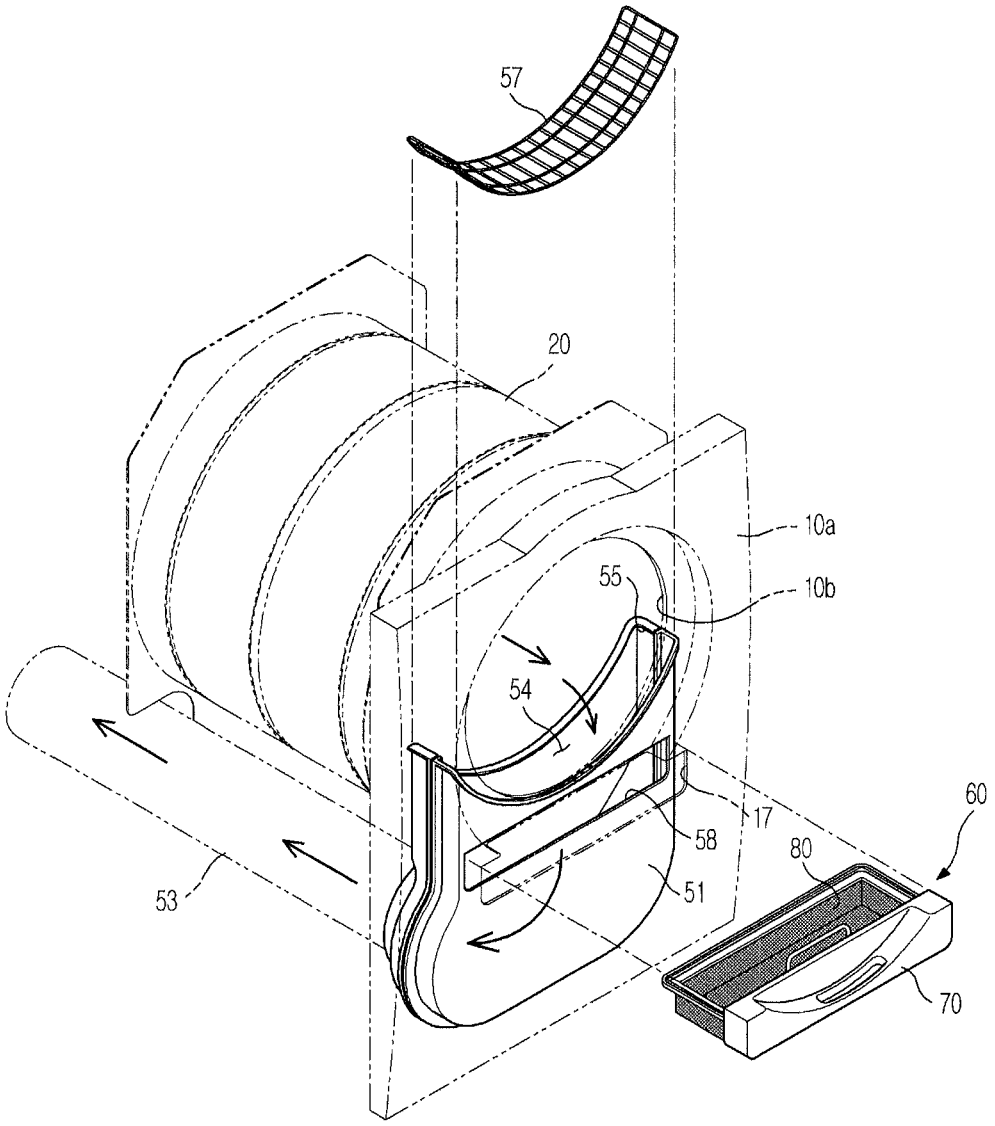
FIG. 3 is a view illustrating the coupling structure of a filter device when viewed from the front of a front frame according to an embodiment of the present invention.
Figure 4:
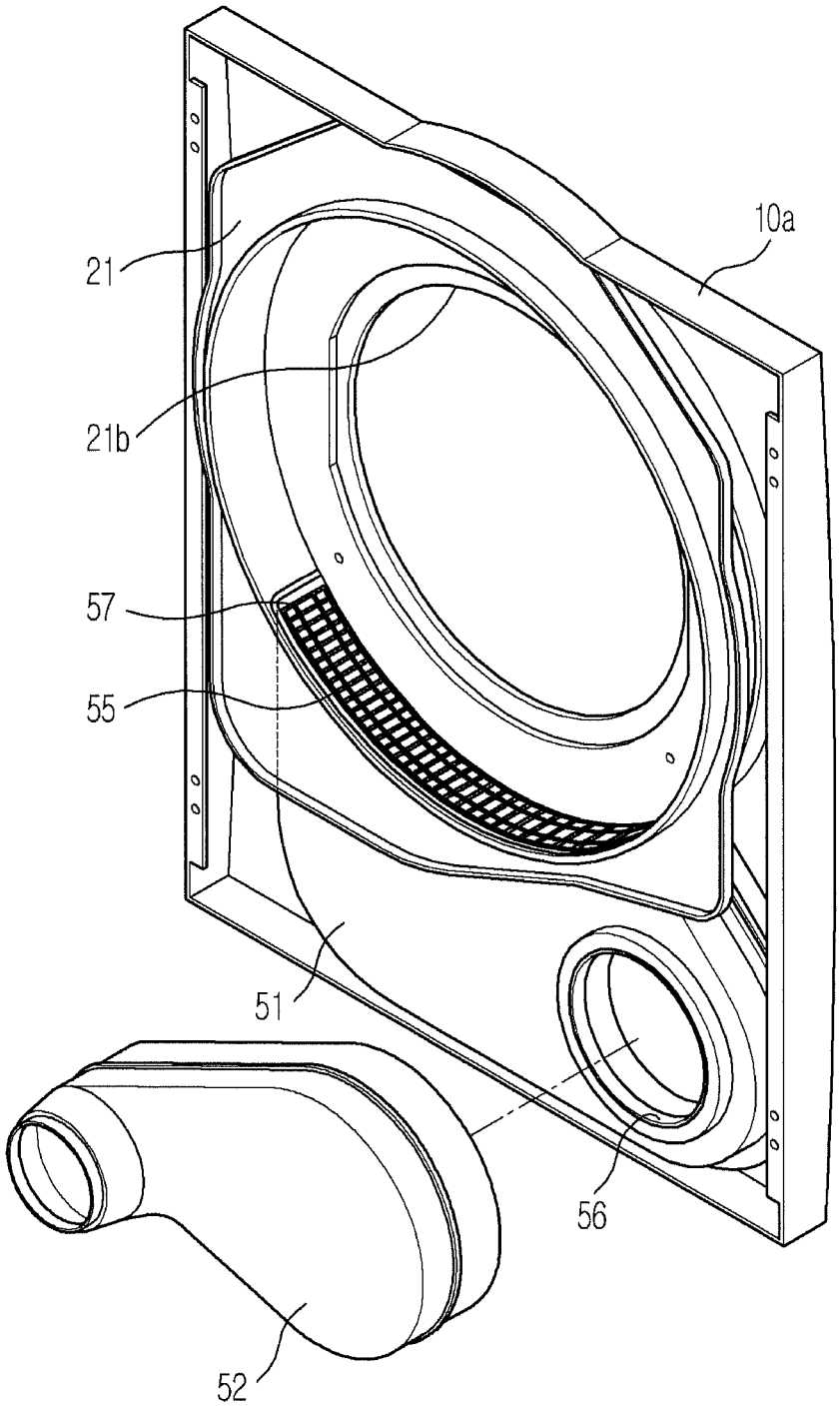
FIG. 4 is a view illustrating the coupling structure of the filter device when viewed from the rear of the front frame according to the embodiment of the present invention.
Figure 5:
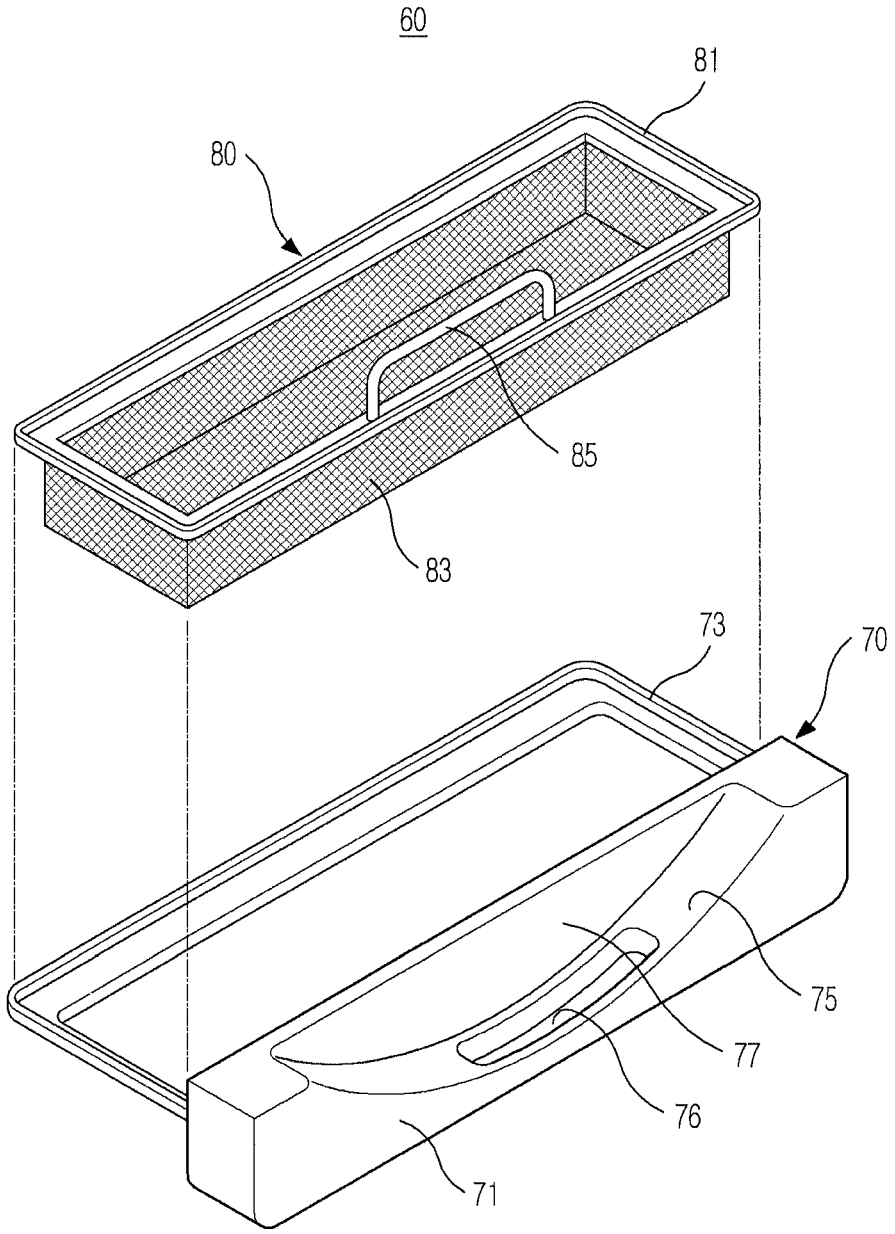
FIG. 5 is an exploded perspective view illustrating a filter device according to an embodiment of the present invention.

FIG. 3 is a view illustrating the coupling structure of a filter device when viewed from the front of a front frame according to an embodiment of the present invention. FIG. 4 is a view illustrating the coupling structure of the filter device when viewed from the rear of the front frame according to the embodiment of the present invention. FIG. 5 is an exploded perspective view illustrating a filter device according to an embodiment of the present invention.

Referring to FIGS. 3 to 5, the filter duct 51 is mounted at the rear of the front frame 10*a*. The filter duct 51 is disposed upstream of the fan 52*a* to form a flow channel 54 along which air having dried an object to be dried is discharged. The filter device 60, which filters foreign matter from air introduced into the flow channel 54, is detachably mounted in the flow channel 54 of the filter duct 51.

The filter duct 51 may include an inlet 55 communicating with the drying drum 20 and an outlet 56 communicating with the blowing case 52 having the fan 52 mounted therein.

A net type filter grill 57 may be mounted at the inlet 55 of the filter duct 51. A filter insertion port 58 may be formed at one side of the filter duct 51 facing the front frame 10*a*.

The filter insertion port 58 forms an entrance into which the filter 80 of the filter device 60 is inserted. The filter insertion port 58 may have a size corresponding to the filter 80.

Also, the filter duct 51 is mounted below the front support plate 21. A filter mounting part 17 may be provided at the front frame 10*a* facing the filter insertion port 58 so that the filter case 70 is mounted in the filter mounting part 17.

The filter mounting part 17 may be formed in a shape corresponding to the filter case 70.

The filter case 70, forming a portion of the front frame 10*a*, opens and closes the filter mounting part 17. The filter 80 is disposed at the rear of the filter case 70 so that the filter 80 is inserted into the filter insertion port 58.

The filter case 70 may be formed in a shape corresponding to the filter mounting part 17 formed at the front frame 10*a*, and the filter 80 may be formed in a shape corresponding to the filter insertion port 58 of the filter duct 51.

Also, the filter 80 may have an area corresponding to the cross-sectional area of the flow channel 54 of the filter duct 51 so that the filter 80 filters foreign mattered introduced into the flow channel 54.

Referring to FIG. 5, the filter case 70 may include a front cover 71 formed in a shape corresponding to the filter mounting part 17 formed at the front frame 10*a* to constitute a portion of the front frame 10*a* and a quadrangular filter location frame 73 extending from the rear of the front cover 71.

The front cover 71 is disposed adjacent to the lower side of the door 15. A depression part 75 corresponding to a lower end portion of the door 15 may be formed at a portion of the front cover 71 adjacent to the lower side of the door 15. A grip part 76 may be provided in the depression part 75 so that a user holds the grip part 76.

Also, a door contact part 77 configured to come into tight contact with the rear of the door 15 may be provided at the front cover 71 above the depression part 75. When the filter case 70 is mounted, the filter case 70 is pushed and supported by the door 15 with the result that separation of the filter device 60 is prevented during operation of the clothing dryer.

The filter 80 may be detachably mounted in the filter case 70 so that the filter 80 is easily cleaned. The filter 80 may include a filter frame 81 located and supported in the filter location frame 73 and a filter net 83 mounted inside the filter frame 81. The filter net 83 is formed in the shape of a box open at the top thereof.

The filter net 83 is disposed in the flow channel 54 of the filter duct 51 to filter foreign matter from air flowing in the flow channel 54. The filter net 83 may be made of woolen fabric (cloth), polyethylene terephthalate (PET), or steel depending upon the shape of an object to be dried or the purpose of use.

A grip part 85, which a user may hold upon separation of the filter net 83, may be provided at the filter frame 81.

Hereinafter, the operation of the clothing dryer according to the embodiment will be described.

Figure 6:
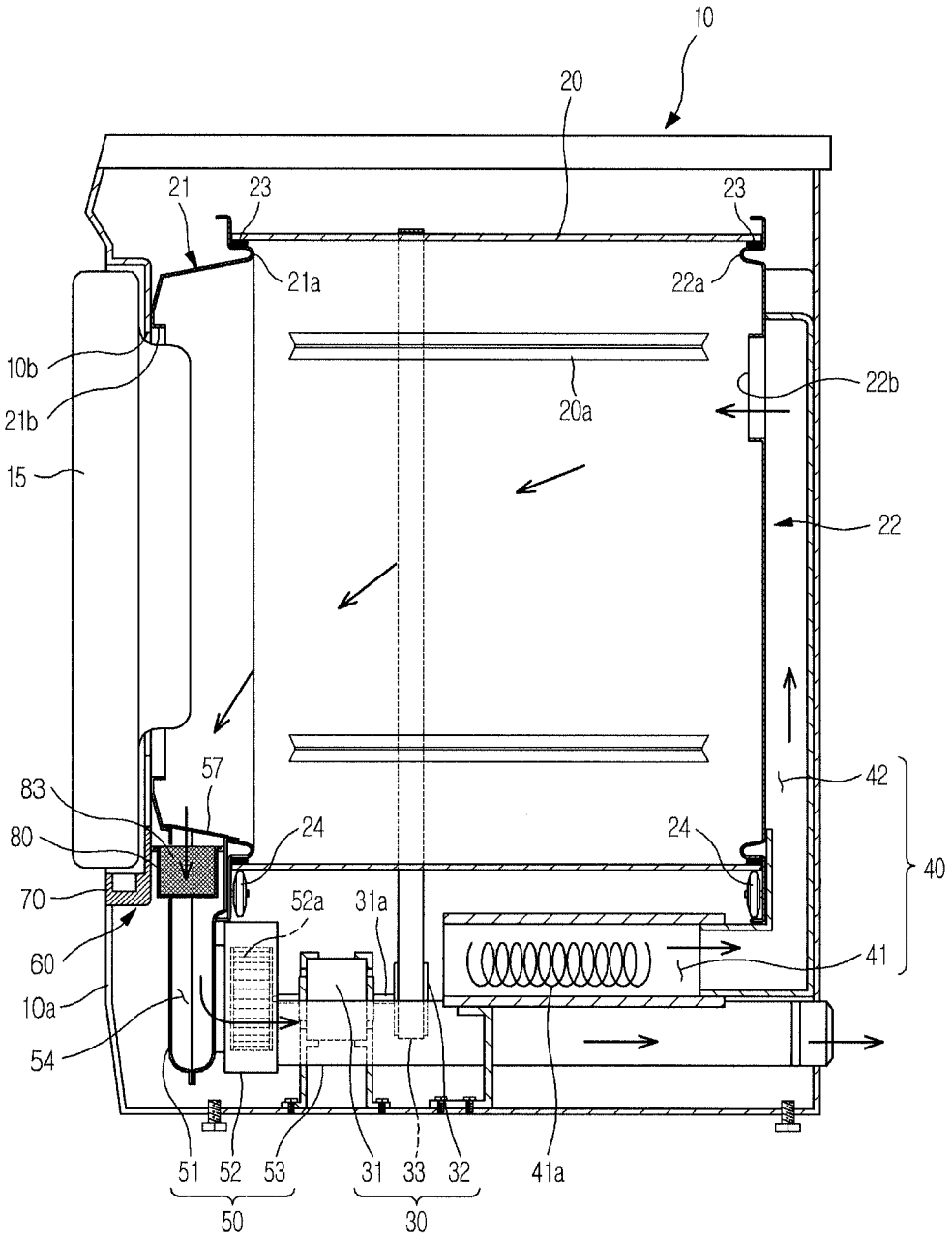
FIG. 6 is a view illustrating a hot air flow route in the clothing dryer according to the embodiment of the present invention.
Figure 7:
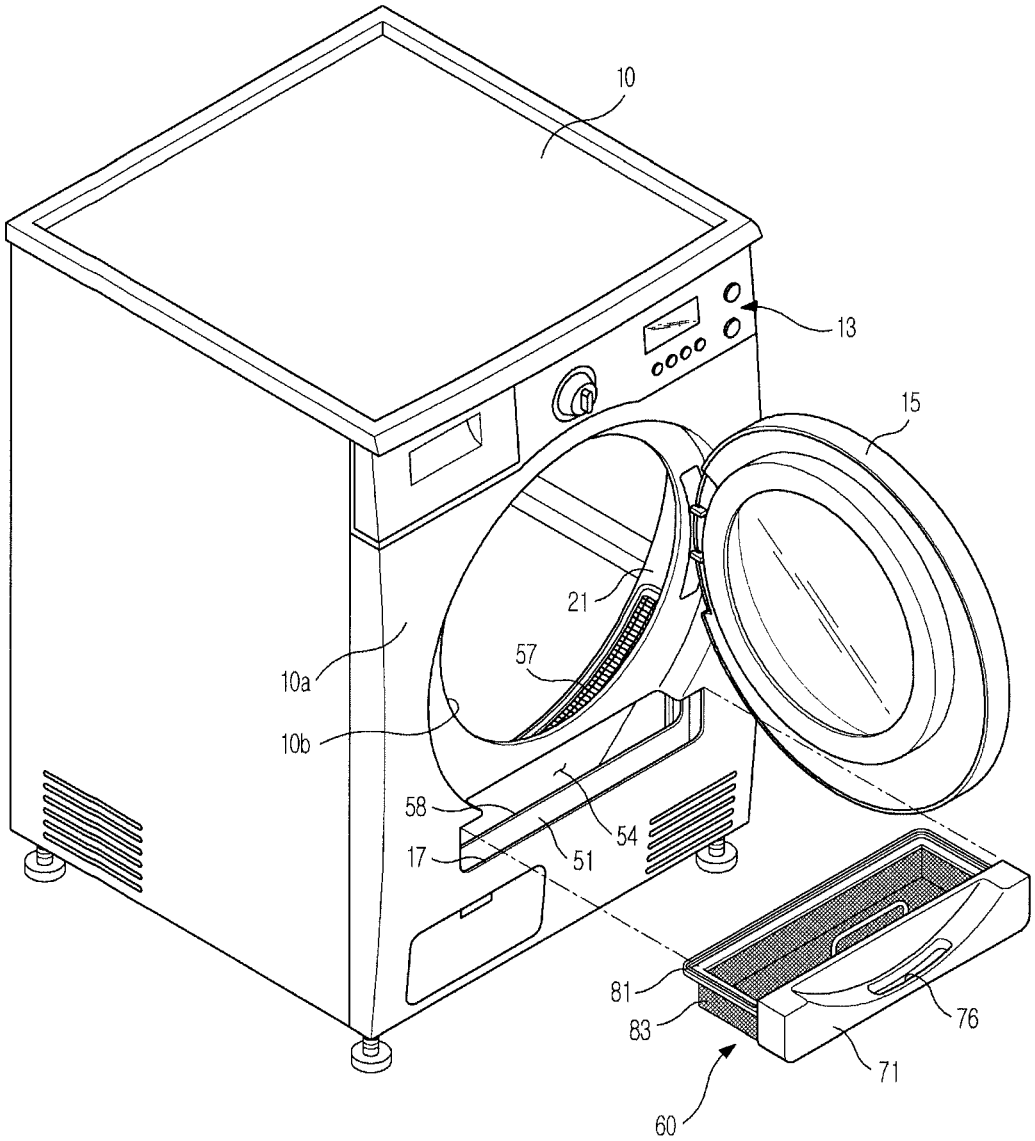
FIG. 7 is a view illustrating a state in which the filter device according to the embodiment is pulled out of the clothing dryer.

FIG. 6 is a view illustrating a hot air flow route in the clothing dryer according to the embodiment and FIG. 7 is a view illustrating a state in which the filter device according to the embodiment is pulled out of the clothing dryer.

In this embodiment, a user may directly confirm whether the filter device is mounted in the clothing dryer with the naked eye from the outside of the front frame 10*a*, thereby preventing the fan 52*a* from being damaged due to the absence of the filter device.

That is, the front cover 71 of the filter device 60 forms a portion of the front frame 10*a*. In the absence of the filter device 60, therefore, the filter mounting part 17 is open. Consequently, whether the filter device is mounted in the clothing dryer is easily confirmed.

When the clothing dryer is operated, as shown in FIG. 6, high-temperature, low-humidity air introduced into the drying drum 20 by the hot air supply unit 40 absorbs moisture from an object to be dried in the drying drum 20 to dry the object. As a result, the high-temperature, low-humidity air changes into high-temperature, high-humidity air, which is introduced into the filter duct 51 by suction force from the fan 52*a*.

Foreign matter contained in the air introduced into the flow channel 54 of the filter duct 51 is filtered by the filter net 83. The air, from which the foreign matter has been removed, is discharged out of the cabinet 10 via the blowing case 52 and the exhaust duct 53.

When the user pulls the filter device 60 while holding the grip part 76 of the filter device 60, as shown in FIG. 7, to replace or clean the filter 80, the filter 60 is moved outward from the front frame 10*a* in a horizontal state.

Consequently, foreign matter attached to the filter net 83 is prevented from being separated from the filter net 83 when the filter is pulled out, thereby preventing a malfunction of the clothing dryer due to foreign matter and thus improving reliability of the clothing dryer.

Also, the user pulls the filter device from the front of the front frame 10*a* to easily replace the filter, thereby improving usability.

In this embodiment, the filter device is applied to an exhaust type clothing dryer. Alternatively, the filter device may be applied to a condensing type clothing dryer having a circulation channel. Also, the kind of the clothing dryer is not restricted so long as the clothing dryer has a filter device to remove foreign matter introduced into a flow channel along which air having dried an object to be dried is discharged.

Also, in this embodiment, the front cover of the filter device forms a portion of the front frame. Alternatively, the front cover may form a portion of the door or one side of the cabinet depending upon the structure of the flow channel along which air having dried an object to be dried is discharged. In this case, the filter device may be detachably mounted in the flow channel upstream of the fan so that foreign matter is not introduced into the fan.

As is apparent from the above description, whether the filter device is mounted in the clothing dryer according to the embodiment is confirmed.

Also, the filter is easily cleaned.

Also, usability and reliability of the clothing dryer according to the embodiment are improved.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A clothing dryer comprising:

a cabinet having a front frame at which an introduction port is formed;

a drying drum rotatably mounted in the cabinet;

a filter device to filter foreign matter in a flow channel along which air having dried an object to be dried in the drying drum is discharged by suction force of a fan; and a filter mounting part formed at one side of the front frame so that the filter device is mounted in the filter mounting part, wherein the filter device comprises a front cover to cover the filter mounting part, and the front cover comprises a front part forming a front surface of the cabinet, and a door contact part configured to come into contact with one side of a rear of the door and recessed rearward from the front part corresponding to a rearmost portion of the door.

2. The clothing dryer according to claim 1, wherein the filter device comprises a box type filter mounted in the flow channel to filter out the foreign matter, and the filter device is mounted so as to be moved inward into and outward from the filter mounting part in a horizontal state.

3. The clothing dryer according to claim 2, wherein the filter device further comprises a filter location frame extending from a rear of the front cover so that the filter is located in the filter location frame.

4. The clothing dryer according to claim 2, further comprising:

a door to open and close the introduction port, wherein the filter mounting part is disposed adjacent to a lower side portion of the introduction port, and the front cover further comprises a depression part corresponding to a lower side portion of the door.

5. The clothing dryer according to claim 3, wherein the filter is detachably mounted in the filter location frame, and the filter is made of woolen fabric, PET, or steel.

6. The clothing dryer according to claim 1, further comprising:

a fan mounted in the flow channel to generate suction force to suction air in the drying drum and a filter duct mounted in the flow channel upstream of the fan, wherein the filter duct is provided with a filter insertion port formed in a shape corresponding to the filter so that the filter is inserted into the filter duct through the filter insertion port.

7. The clothing dryer according to claim 6, wherein the filter duct comprises an inlet communicating with the drying drum and an outlet communicating with the flow channel in which the fan is mounted, the inlet being provided with a net type filter grill.

8. A clothing dryer comprising:

a cabinet having a front frame at which an introduction port is formed;

a door rotatably mounted at the front frame to open and close the introduction port;

a drying drum rotatably mounted in the cabinet;

a filter duct disposed adjacent to a rear of the front frame to form a portion of a flow channel along which air having dried clothing in the drying drum is discharged; and a filter device detachably mounted in the filter duct so that the filter device is moved inward into and outward from the cabinet in a horizontal state to filter foreign matter from air introduced into the filter duct, wherein the filter device comprises a filter case forming a portion of the front frame, and the filter case includes a front part forming a front surface of the cabinet, and a door contact part recessed rearward from the front part corresponding to a rearmost portion of the door.

9. The clothing dryer according to claim 8, wherein the clothing dryer is an exhaust type clothing dryer or a condensing type clothing dryer having a circulation channel.

10. The clothing dryer according to claim 8, wherein the filter device further comprises a filter mounted in the flow channel of the filter duct, and the filter is detachably mounted at the filter case.

11. The clothing dryer according to claim 10, wherein the filter duct has a filter insertion port through which the filter is inserted into the flow channel of the filter duct.

12. The clothing dryer according to claim 11, wherein the filter duct comprises an inlet communicating with the drying drum and an outlet communicating with a blowing case having a fan mounted therein to generate suction force in the drying drum, and the inlet is provided with a net type filter grill.

13. The clothing dryer according to claim 11, wherein the front frame is provided with a filter mounting part in which the filter case is mounted and supported, and the filter case comprises a front cover to cover the filter mounting part and a filter location frame in which the filter is located, the filter location frame being mounted in the filter duct.

14. The clothing dryer according to claim 13, wherein the front cover is disposed adjacent to a lower side of the door, and the front cover is provided with a depression part corresponding to a lower end portion of the door.

15. The clothing dryer according to claim 14, wherein the depression part is provided with a depressed grip part configured to be held by a user.

16. The clothing dryer according to claim 13, wherein the filter comprises a quadrangular filter frame located and supported in the filter location frame and a filter net mounted inside the filter frame to filter out foreign matter, the filter net being formed in a shape of a box opened at a top thereof.

17. The clothing dryer according to claim 16, wherein the filter net is made of woolen fabric, polyethylene terephthalate (PET), or steel.

18. The clothing dryer according to claim 14, wherein the filter duct is disposed adjacent to a lower side of the introduction port.

19. The clothing dryer according to claim 14, further comprising:

a front support plate to rotatably support a front end of the drying drum, the front support plate having an opening corresponding to the introduction port, wherein the filter duct is disposed between the front frame and the front support plate.

20. The clothing dryer according to claim 13, wherein the front cover is provided with the door contact part configured to come into tight contact with one side of a rear of the door when the filter device is mounted at the cabinet.

* * * * *